US005328033A

United States Patent [19]

Ptaschinski

[11] Patent Number: 5,328,033

[45] Date of Patent: Jul. 12, 1994

[54] INSERT FOR BICYCLE SHIPPING CONTAINER

[75] Inventor: Michael J. Ptaschinski, Beaver Dam, Wis.

[73] Assignee: International Paper Company, Purchase, N.Y.

[21] Appl. No.: 108,969

[22] Filed: Aug. 19, 1993

[51] Int. Cl.[5] ..... B65D 81/02; B65D 85/68

[52] U.S. Cl. ..... 206/586; 206/335

[58] Field of Search ..... 206/586, 335, 814

[56] References Cited

U.S. PATENT DOCUMENTS

| | | | |
|---|---|---|---|
| 1,585,684 | 5/1926 | Oppenheim | 206/586 |
| 1,783,570 | 12/1930 | Hill . | |
| 2,299,355 | 10/1942 | Stolpman . | |
| 2,330,448 | 9/1943 | Reaume | 206/335 |
| 2,339,947 | 1/1944 | Reaume . | |
| 2,651,448 | 9/1953 | Dusseault | 206/335 |
| 2,660,297 | 11/1953 | D'Esposito | 206/335 |
| 4,170,297 | 10/1979 | Johnson . | |
| 4,469,224 | 9/1984 | Ritter . | |

FOREIGN PATENT DOCUMENTS

| | | | |
|---|---|---|---|
| 978904 | 12/1975 | Canada | 206/586 |
| 3303180 | 8/1984 | Fed. Rep. of Germany | 206/586 |

*Primary Examiner*—William I. Price

*Attorney, Agent, or Firm*—Michael J. Doyle

[57] ABSTRACT

A unitary corrugated board insert for a bicycle shipping container. The insert is fashioned from a generally unitary blank of corrugated paperboard, with panels of the insert defined by vertically extending score or fold lines. One of the panels is provided on one of its surfaces with an adhesive. The insert is formed by folding the several panels about the fold lines so as to yield an insert in the general form of two vertically running channels or enclosures for parts which must be added by the consumer to complete the assembly of the bicycle. These two channels are joined by folding the blank and attaching its free left and right ends to that panel which has been provided with adhesive. The two channels store some of the components of the bicycle which must be added by the consumer to complete bicycle assembly. The channels also sandwich a portion of the rear wheel of the bicycle to thereby provide shock resistance to the wheel and to assist in maintaining the bicycle in its desired position within the shipping container.

9 Claims, 2 Drawing Sheets

INSERT FOR BICYCLE SHIPPING CONTAINER

BACKGROUND OF THE INVENTION

This invention relates to a packaging insert and more particularly to an insert for packaging a bicycle in a shipping container, the latter typically formed of corrugated paperboard.

Bicycle shipping containers and inserts for them are known and are described in, for example, U.S. Pat. No. 2,299,355 issued to Stolpman, and U.S. Pat. No. 2,330,448 issued to Reaume, and U.S. Pat. No. 2,339,947 issued to Reaume, and U.S. Pat. No. 2,660,297 issued to Desposito, and U.S. Pat. No. 4,469,224 issued to Ritter. With many bicycles shipped from factories in only partially assembled condition, inserts are often used for the segregation and storing of various components which must be added by the customer to complete the assembly of the bicycle.

Inserts for containers are typically employed to position an article packaged within the container, to provide protection against shock forces, and often to define compartments for storing components required for full assembly of the packaged article.

SUMMARY OF THE INVENTION

According to the practice of this invention, a packaging insert which defines combination spacer and holder for parts for a bicycle container is formed from a unitary blank of corrugated paperboard or other stiff, resilient, and foldable sheet material. The blank is first folded along score or fold lines, and then erected by means of gluing, and then placed into a container, typically also of corrugated board, for a partially assembled bicycle. The packaging insert is fashioned so as to define two elongated channels for the reception of parts of the bicycle, such as handle grips, bicycle seat stem, pedals, and the like. Further, these two elongated channels sandwich a portion of the rear wheel of the bicycle to thus assist in both maintaining the bicycle in its desired relationship to the shipping container, and to provide shock protection to the rear wheel.

DETAILED DESCRIPTION OF THE INVENTION

Figure 1:
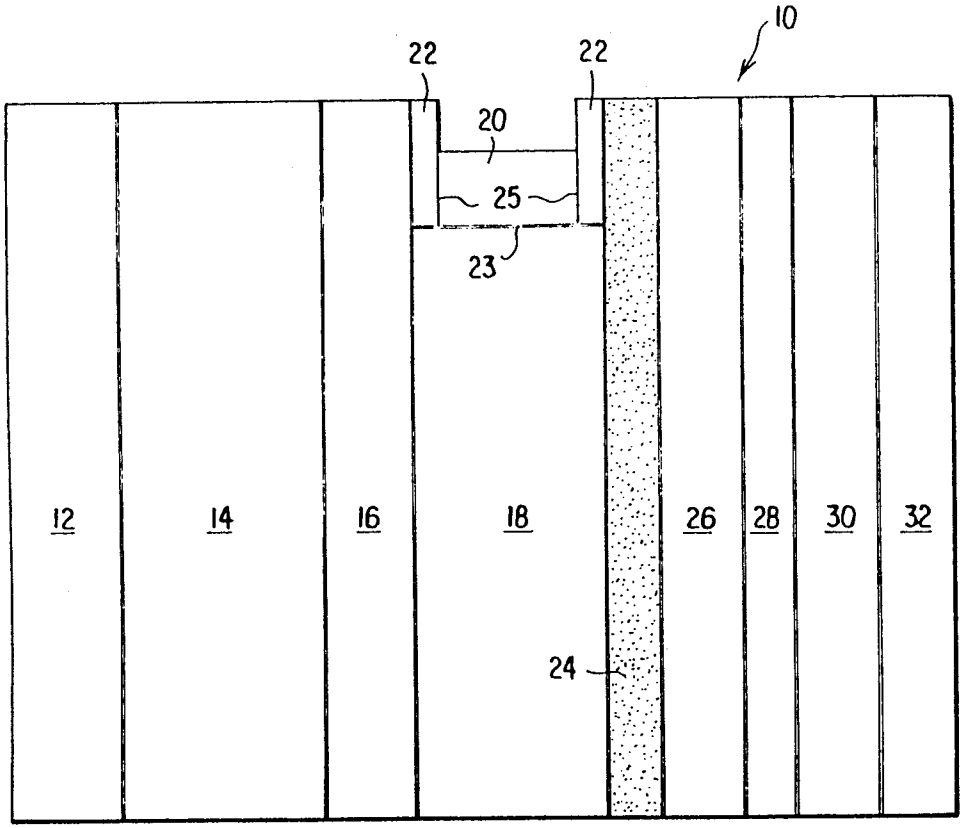
FIG. 1 is a plan view of a unitary blank of corrugated paperboard or the like for forming the insert of this invention.

Referring now to FIG. 1, a generally rectangular and unitary blank of corrugated paperboard or the like is designated as 10 and includes a plurality of panels 12, 14, 16, 18, 20, 22, 24, 26, 28, 30, and 32. Except for panel 20, the panels are generally rectangular and have their longitudinal axes running vertically. The panels are separated from each other by the indicated vertically running score lines which define fold or bend lines, while the bottoms of panels 20 and 22 meet a horizontal fold line 23 extending between panels 16 and 24. Panel 24 is provided on one of its surfaces with an adhesive material, the latter designated as 25 in FIG. 4, the latter shortly to be described. It will be observed that panel 20 is bordered at its top by a free edge, i.e., an edge not connected to any other panel, at its bottom by a horizontal score line 23, and at it sides by cut lines 25. Thus, panels 20 and 22 are not joined to each other, and each of these panels carries on its lower end a horizontal fold line. Blank 10 has an upper free edge, a lower free edge, and two free side edges.

Figure 2:
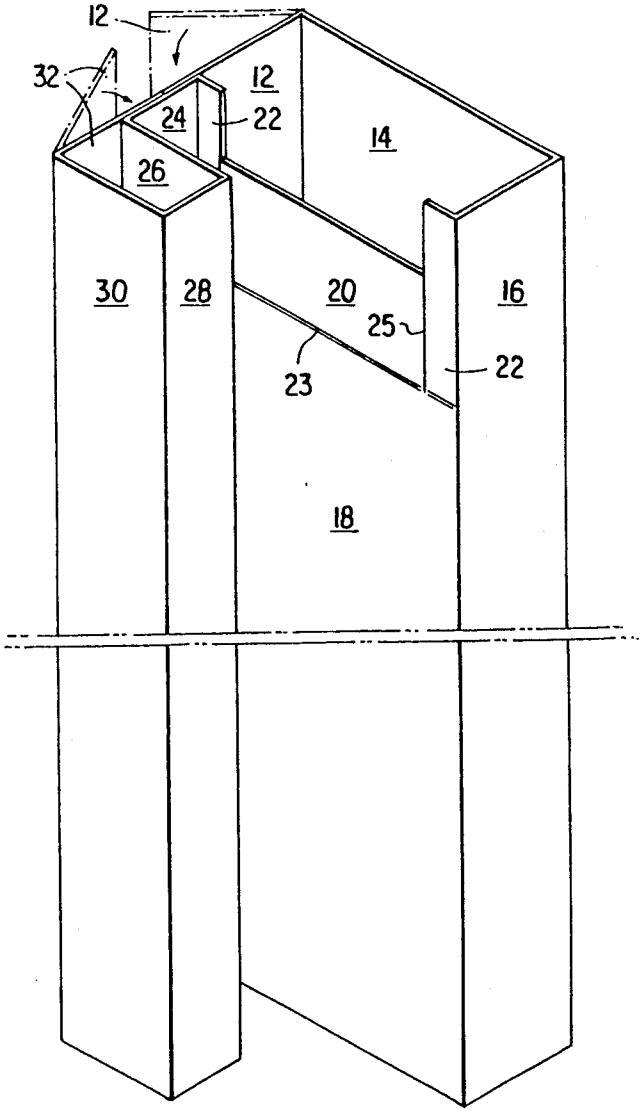
FIG. 2 is a perspective view illustrating the manner or formation of the packaging insert from the blank of FIG. 1.

Referring now to FIG. 2 of the drawings, blank 10 has been folded about the score lines to assume the configuration illustrated. The dashed lines at the top of FIG. 2 indicate the folding of panels 12 and 32 onto the adhesive 25 on one surface of panel 24, that surface being the one away from the reader in FIG. 2. It is seen that edge portions of panels 12 and 32 are secured by adhesive 25 (see FIG. 4) to panel 24.

Figure 3:
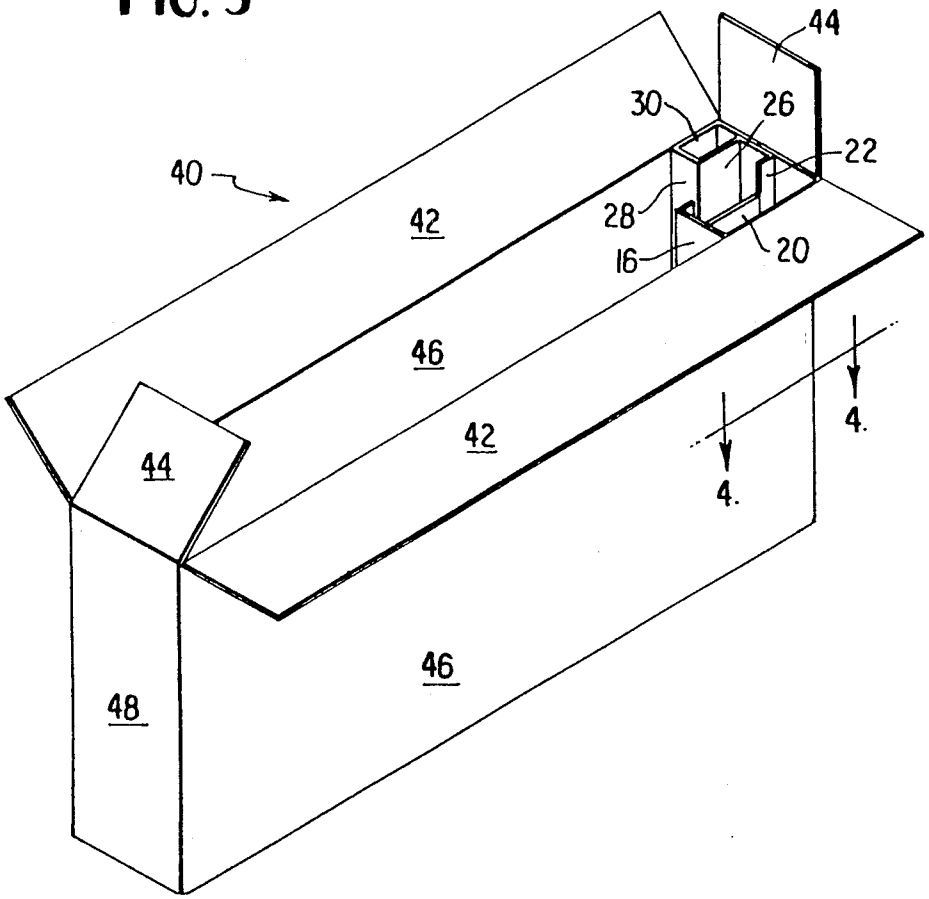
FIG. 3 is a perspective view illustrating the packaging insert of this invention in a shipping container.

Turning now to FIG. 3, an outer shipping container, typically of corrugated board, is designated as 40, having a pair of top closure panels 42, a pair of top end minor closure panels 44, side panels 46 and end panels 48, only one of which is shown. The insert shown at FIG. 2 has been placed at the right hand end of the interior of container 40 against right end wall 48.

Figure 4:
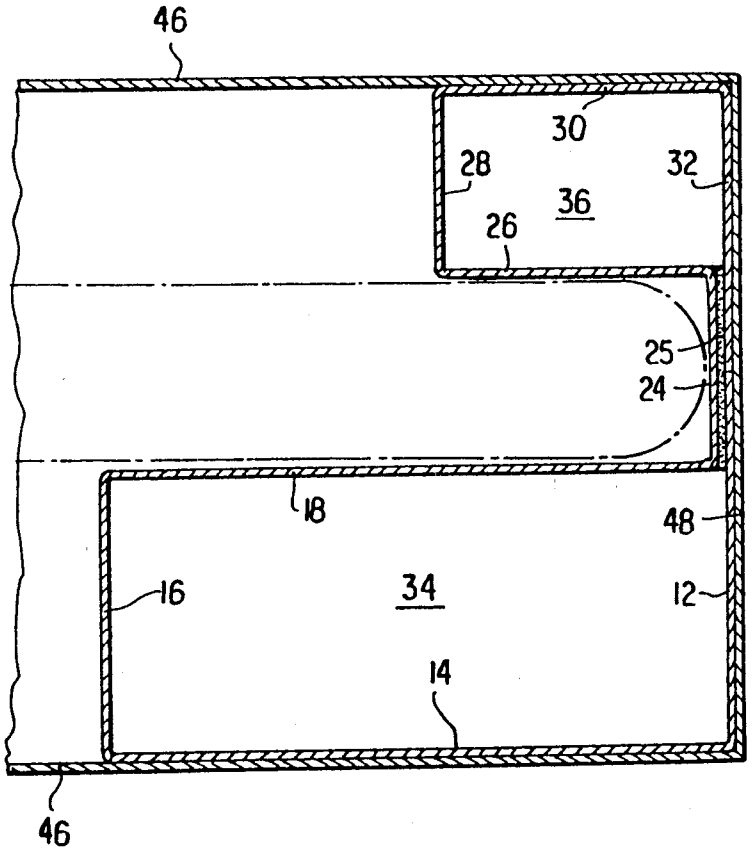
FIG. 4 is a view taken along section 4—4 of FIG. 3.

FIG. 4, being a section along 4—4 of FIG. 3, shows vertical channels 34 and 36 formed from the indicated panels. FIG. 4 also illustrates the adhesive 25 on one of the surfaces of panel 24. FIG. 4 also illustrates a portion of the upstanding side walls 46 of the outer container 40, as well as one of the end walls 48.

In use, a partially assembled bicycle is placed in container 40, with its front wheel (not shown) at the left interior portion of the container, and its rear wheel between channels 34 and 36, the latter shown at FIG. 4. The rear wheel is indicated by dashed lines at FIG. 4.

Typically, channel 36 will contain a parts bag which may include pedals, reflectors, handle grips, and a handlebar. Compartment 34 will typically hold the stem for the seat and the seat. While not shown at FIGS. 2 or 3 since neither the bicycle or any of its spare parts are shown in the drawings, the reader will understand that panel 20 will be bent forward, towards the reader of FIG. 2, by about 30 degrees to provide a cushion for a portion of the seat. Panels 22 serve to increase the structural rigidity and shock resistance of the insert, as well as to be preclude exposed flutes from the corrugations of panels 16 and 24. While panels 22 could be omitted, the presence of the right hand panel 22 at FIG. 2 prevents the exposure of flutes from the corrugated board, to thereby inhibit rubbing of exposed flutes against any part of the rear wheel.

In the above description, geometrical terms of orientation such as vertical, horizontal, and the like are intended to facilitate a description and are not intended as terms of limitation.

I claim:

1. A unitary, generally rectangular blank of corrugated paperboard adapted to be folded into an insert for a bicycle shipping container, the blank having left and right and upper and lower free edges and provided with a plurality of vertically extending and spaced fold lines to thereby define nine generally rectangular panels having their longitudinal axes extending vertically, the fourth panel from said left edge of said blank having a horizontal fold line extending between said third and said fifth panels, a pair of vertically extending cut lines above said horizontal fold line to thereby define a flap, the fifth panel from the left being provided on one of its surfaces with an adhesive over at least a portion of its surface.

2. The blank of claim 1 wherein said flap in said fourth panel has an upper free edge lower than said upper free edge of said blank.

3. A packaging insert for a bicycle container, said packaging insert fashioned from a unitary blank of corrugated paperboard, said blank having opposed edge portions, said shipping insert including two vertically extending channels each of polygonal transverse cross section, said channels joined together by a panel extending between them, said channels having respective opposed surfaces spaced from each other to thereby define a space for the reception of an article to be packaged, one surface of said connecting panel provided with an adhesive to thereby secure said connecting panel surface to said opposed edge portions.

4. The packaging insert of claim 3 wherein one of said channels is of larger polygonal transverse cross section than the other.

5. The packaging insert of claim 3 wherein one of said vertically extending channels is provided with a flap which is horizontally bendable outwardly towards said other vertically extending channel.

6. The insert of claim 3 wherein said panel has two surfaces, one of which faces said space for the reception of a bicycle wheel, and the other of which is provided with said adhesive.

7. The insert of claim 3 wherein said respective opposed surfaces of said channels are parallel.

8. The insert of claim 5 wherein said panel has two surfaces, one of which faces said space for the reception of a bicycle wheel, and the other of which is provided with said adhesive.

9. The insert of claim 5 wherein said respective opposed surfaces of said channels are parallel.

* * * * *